US008413830B2

(12) United States Patent
Guglielmini

(10) Patent No.: US 8,413,830 B2
(45) Date of Patent: Apr. 9, 2013

(54) CLOSURE

(75) Inventor: Bernard Guglielmini, Aigues Mortes (FR)

(73) Assignee: Obrist Closures Switzerland GmbH, Reinach (CH)

( * ) Notice: Subject to any disclaimer, the term of this patent is extended or adjusted under 35 U.S.C. 154(b) by 0 days.

(21) Appl. No.: 12/918,919

(22) PCT Filed: Jan. 9, 2009

(86) PCT No.: PCT/GB2009/000048

§ 371 (c)(1),
(2), (4) Date: Oct. 4, 2010

(87) PCT Pub. No.: WO2009/122118

PCT Pub. Date: Oct. 8, 2009

(65) Prior Publication Data

US 2011/0017736 A1 Jan. 27, 2011

(30) Foreign Application Priority Data

Apr. 4, 2008 (GB) ..... 0806190.5

(51) Int. Cl.
*B65D 41/00* (2006.01)
*B65D 41/04* (2006.01)
*B65D 47/00* (2006.01)

(52) U.S. Cl.
USPC ..... 215/235; 215/252; 220/288; 220/366.1; 222/556

(58) Field of Classification Search ..... 215/235, 215/252, 258, 274; 220/212, 254.3, 254.5, 220/288, 366.1; 222/556
See application file for complete search history.

(56) References Cited

U.S. PATENT DOCUMENTS

| | | | |
|---|---|---|---|
| 1,798,151 | A | 3/1931 | Fabrice |
| 2,858,054 | A | 10/1958 | Harkrader |
| 3,348,718 | A | 10/1967 | Musy |
| 3,412,890 | A | 11/1968 | Rich |
| 3,425,578 | A | 2/1969 | Owens |
| 3,455,479 | A | 7/1969 | Wilton |
| 3,603,470 | A | 9/1971 | Armour |
| 3,810,556 | A | 5/1974 | Coursaut |
| 3,820,683 | A | 6/1974 | Jasinski |
| 3,871,545 | A | 3/1975 | Bereziat |
| 3,892,351 | A | 7/1975 | Johnson et al. |
| 4,091,949 | A | 5/1978 | Fowles et al. |

(Continued)

FOREIGN PATENT DOCUMENTS

| | | |
|---|---|---|
| DE | 809 896 | 8/1951 |
| DE | 861 666 | 1/1953 |

(Continued)

OTHER PUBLICATIONS

Serial No. PCT/EP2005/053441, completed Dec. 1, 2005, International Search Report and Written Opinion of the International Searching Authority, 5 pages.

(Continued)

*Primary Examiner* — Anthony Stashick
*Assistant Examiner* — Madison L Poos
(74) *Attorney, Agent, or Firm* — Andrew F. Young, Esq.; Lackenbach Siegel, LLP

(57) ABSTRACT

A closure is provided and comprises a body and an inset. The closure has a drainage system for allowing fluid applied to the closure to pass between the exterior of the insert and the interior of the body to allow removal thereof.

17 Claims, 5 Drawing Sheets

U.S. PATENT DOCUMENTS

| | | | |
|---|---|---|---|
| 4,303,171 | A | 12/1981 | Shremmer |
| 4,310,105 | A | 1/1982 | Gach |
| 4,531,649 | A | 7/1985 | Shull |
| 4,569,464 | A | 2/1986 | Wassilieff |
| 4,637,519 | A | 1/1987 | Dutt et al. |
| 4,697,719 | A | 10/1987 | Allen |
| 4,744,480 | A | 5/1988 | Luch et al. |
| 4,790,442 | A | 12/1988 | Gach |
| 4,838,441 | A | 6/1989 | Chernack |
| 4,941,592 | A | 7/1990 | Kitterman |
| 4,942,970 | A | 7/1990 | Jay |
| 5,004,126 | A | 4/1991 | Klesius |
| 5,009,324 | A | 4/1991 | Ochs |
| 5,332,113 | A | 7/1994 | Kusler et al. |
| 5,427,260 | A | 6/1995 | Mueller et al. |
| 5,445,824 | A | 8/1995 | Someya |
| 5,588,545 | A | 12/1996 | King et al. |
| 5,603,422 | A | 2/1997 | Herrmann |
| 5,683,016 | A | 11/1997 | Santagiuliana |
| 5,819,965 | A | 10/1998 | King et al. |
| 6,036,036 | A | 3/2000 | Bilani et al. |
| 6,095,375 | A | 8/2000 | Adams et al. |
| 6,269,986 | B1 | 8/2001 | Gross |
| 6,484,879 | B2 | 11/2002 | Desmarais et al. |
| 6,683,038 | B2 | 1/2004 | Forth et al. |
| 6,685,046 | B2 | 2/2004 | Ogino |
| 6,688,501 | B2 | 2/2004 | DeGroot et al. |
| 6,727,215 | B2 | 4/2004 | Roberts et al. |
| 6,866,164 | B2 | 3/2005 | Branson et al. |
| 6,880,729 | B2 | 4/2005 | Stull et al. |
| 7,121,419 | B2 | 10/2006 | Ferry et al. |
| 7,125,828 | B2 | 10/2006 | Catlin et al. |
| 7,204,383 | B2 | 4/2007 | Hsu |
| 2002/0066713 | A1 | 6/2002 | Ma |
| 2002/0125249 | A1 | 9/2002 | Baird-Smith et al. |
| 2003/0116522 | A1 | 6/2003 | Julian et al. |
| 2004/0026420 | A1 | 2/2004 | Smith |
| 2004/0143505 | A1 | 7/2004 | Kovach |
| 2005/0133475 | A1 | 6/2005 | Goto et al. |
| 2005/0205607 | A1 | 9/2005 | Hierzer et al. |
| 2006/0011573 | A1 | 1/2006 | Herald et al. |
| 2006/0043052 | A1 | 3/2006 | Lin |
| 2006/0077062 | A1 | 4/2006 | Andrechak et al. |
| 2006/0124646 | A1 | 6/2006 | Gugliemini et al. |
| 2007/0181525 | A1 | 8/2007 | Gregory et al. |
| 2007/0295765 | A1 | 12/2007 | Bull et al. |
| 2008/0277613 | A1 | 11/2008 | Ramsey et al. |

FOREIGN PATENT DOCUMENTS

| | | | |
|---|---|---|---|
| DE | 85 35 205 | U1 | 2/1986 |
| DE | 3 605 963 | A1 | 8/1987 |
| DE | 200 19 797 | U1 | 5/2001 |
| EP | 0 127 943 | A1 | 12/1984 |
| EP | 0 132 792 | A1 | 2/1985 |
| EP | 0 179 498 | A1 | 4/1986 |
| EP | 0 236 136 | A2 | 9/1987 |
| EP | 0 306 670 | A2 | 3/1989 |
| EP | 0 337 568 | A2 | 10/1989 |
| EP | 0 414 462 | A2 | 2/1991 |
| EP | 0 593 952 | A1 | 9/1993 |
| EP | 0 619 243 | A1 | 10/1994 |
| EP | 0 688 723 | A1 | 12/1995 |
| EP | 1 101 707 | A1 | 5/2001 |
| EP | 1 266 839 | A | 12/2002 |
| EP | 1 266 839 | A2 | 12/2002 |
| EP | 1 283 175 | A2 | 2/2003 |
| EP | 1 161 382 | B1 | 9/2003 |
| EP | 2005/053085 | | 6/2004 |
| EP | 1 582 475 | | 3/2005 |
| EP | 0 425 391 71 | | 6/2005 |
| EP | 1 562 475 | A1 | 10/2006 |
| EP | 1 694 576 | B1 | 2/2008 |
| EP | 1 786 698 | B1 | 9/2008 |
| EP | 1 663 809 | B1 | 10/2008 |
| FR | 2 439 139 | A | 5/1980 |
| FR | 2 567 106 | A | 1/1986 |
| FR | 2 591 571 | A | 6/1987 |
| GB | 1 298 084 | A | 11/1972 |
| GB | 1 473 482 | A | 5/1977 |
| GB | 1484517 | | 9/1977 |
| GB | 2 123 392 | A | 2/1984 |
| GB | 2 136 782 | A | 9/1984 |
| GB | 2 148 235 | A | 5/1985 |
| GB | 2 158 424 | A | 11/1985 |
| GB | 2 172 803 | A | 10/1986 |
| GB | 2 222 821 | A | 3/1990 |
| GB | 2 264 110 | B | 8/1993 |
| GB | 2 311 283 | A | 9/1997 |
| GB | 2 355 269 | A | 4/2001 |
| GB | 2 356 842 | A | 6/2001 |
| GB | 2 375 516 | A | 11/2002 |
| GB | 2 415 426 | A | 5/2007 |
| GB | 2 432 153 | A | 11/2007 |
| JP | 10 338251 | A | 3/1999 |
| JP | 2000/229651 | | 8/2000 |
| JP | 2003/160162 | A | 11/2001 |
| JP | 2003/160162 | | 6/2003 |
| WO | WO 91/03404 | | 3/1991 |
| WO | WO 94/07470 | A1 | 4/1994 |
| WO | WO 99/57031 | A1 | 11/1999 |
| WO | WO 00/17092 | | 3/2000 |
| WO | WO 00/26878 | A1 | 5/2000 |
| WO | WO 01/83668 | A1 | 11/2001 |
| WO | WO 02/44047 | A1 | 6/2002 |
| WO | WO 02/085730 | | 10/2002 |
| WO | WO 02/096771 | A1 | 12/2002 |
| WO | WO 03/016162 | A1 | 2/2003 |
| WO | WO 03/016165 | A1 | 2/2003 |
| WO | WO 2004/011347 | | 2/2004 |
| WO | WO 2005/024745 | A2 | 3/2005 |
| WO | WO 2005/049443 | | 6/2005 |
| WO | WO 2006/000532 | A1 | 1/2006 |
| WO | WO 2006/003168 | | 1/2006 |
| WO | WO 2006/008285 | | 1/2006 |
| WO | WO 2006/117505 | | 11/2006 |
| WO | WO 2007/125292 | A2 | 11/2007 |

OTHER PUBLICATIONS

Serial No. PCT/EP2003/07798, mailed Oct. 15, 2004, International Search Report and Written Opinion of the International Searching Authority, 5 pages.

UK Application No. GB 0721330.9; Search Report and Written Opinion dated Feb. 27, 2008; 4 pages.

EP 1 663 809 B1 Documents Related to Opposition (8 pages).

Ser No. PCT/GB2008/03666, International Search Report and Written Opinion, Feb. 24, 2009 (13 pages).

International Search Report and written opinion for PCT/GB2009/000048 (WP 2009/122118A1); (9-pages).

Office Action for GB0806190.5 dated Jul. 29, 2008 (3 pages).

CLOSURE

CROSS REFERENCE TO RELATED APPLICATIONS

This application claims priority from Great Britain Patent Application No. 0806190.5, filed Apr. 4, 2008 and International Application No. PCT/GB2009/000048, filed Jan. 9, 2009, the entire contents of each of which is herein incorporated fully by reference.

FIGURE FOR PUBLICATION

FIG. 6.

BACKGROUND OF THE INVENTION

1. Field of the Invention

The present invention relates generally to a closure, and particularly to a closure including a body part and an insert part.

2. Description of the Related Art

The related art involves closures having two or more components, such as a body and a spout. In many cases it is necessary for extraneous fluid to be applied to such closures. For example, cooling or cleaning fluid is sprayed onto closures during the manufacturing process.

What is not appreciated by the prior art is that it is difficult to produce closures which can reliably prevent the ingress of water between various parts of a body and an insert. The result is that the fluid can become trapped within the closure which is undesirable.

The present invention seeks to address the problems with known closures with a closure comprising a body and an insert, and having a drainage system for allowing fluid applied to the closure to pass between the exterior of the insert and the interior of the body to allow removal thereof.

ASPECTS AND SUMMARY OF THE INVENTION

An aspect of the present invention is to provide a closure comprising a body and an insert, and having a drainage system for allowing fluid applied to the closure to pass between the exterior of the insert and the interior of the body to allow removal thereof.

The drainage system may comprise one or more drainage paths formed at the interface between the insert and the body.

The drainage path or paths may be formed wholly or partly in either, or both of, the body and the insert. The one or more drainage paths may comprise one or more slots formed at the periphery of the insert. The insert itself may comprise a plurality of ribs or radial projections at its periphery. The slots may be formed between the ribs, and may comprise an inclined drainage face to assist drainage.

The insert may comprise a plurality of mutually spaced retention spokes. The spokes may define, at least in part, the drainage paths. Additionally, the insert may comprise a spout. For example, a drinking spout would require sterilization with a cleaning fluid and thereafter the fluid needs to be removed so as not to affect the user's taste.

The body may comprise a base and a lid. The base and lid may be joined by a hinge, such as a snap-hinge. The interface between the lid and the base is a likely point at which fluid will enter.

Another aspect of the present invention is to provide an insert for a closure body, comprising one or more drainage paths for allowing fluid applied to the closure to pass between the exterior of the insert and the interior of the body to allow removal thereof.

The above, and other aspects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
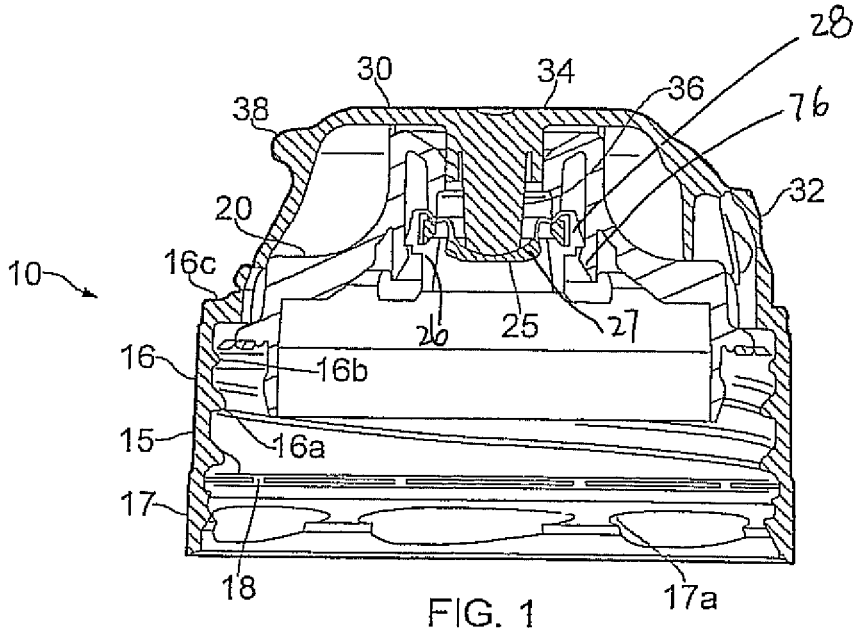
FIG. 1 is a section of a closure formed according to the present invention.

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, and below may be used with respect to the drawings. These and similar directional terms should not be construed to limit the scope of the invention in any manner. The words "connect," "couple," and similar terms with their inflectional morphemes do not necessarily denote direct and immediate connections, but also include connections through mediate elements or devices.

Figure 2:
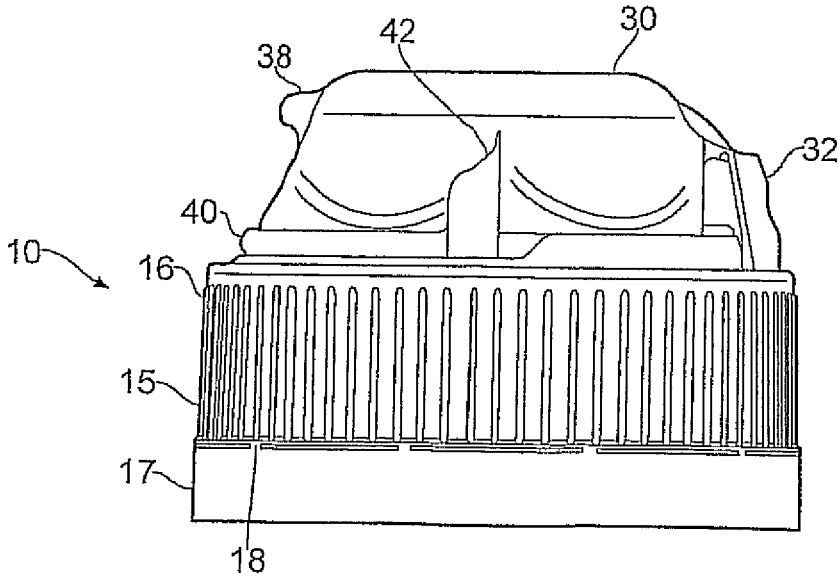
FIG. 2 is a side elevation of the closure of FIG. 1.
Figure 3A:
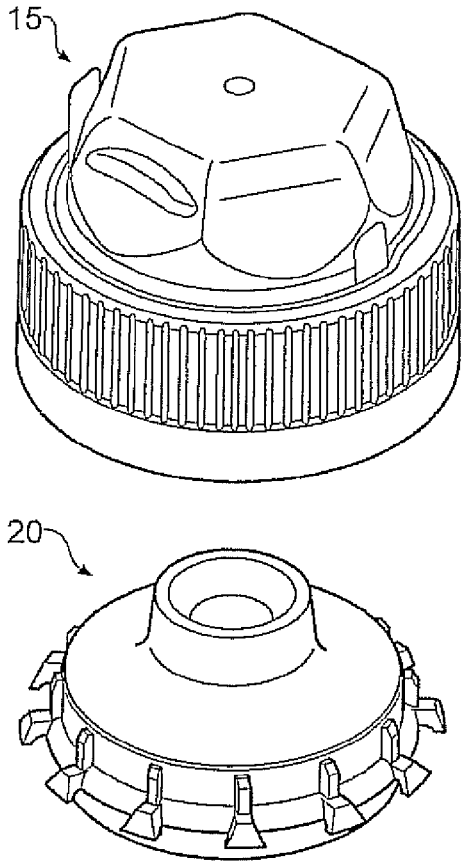
FIG. 3A is an exploded perspective view of the components making up the closure of FIGS. 1 and 2.
Figure 3A:
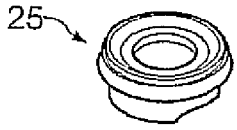
Figure 3B:
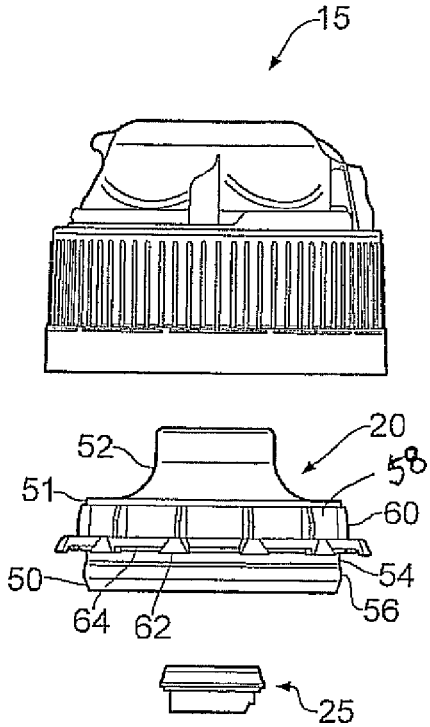
FIG. 3B is a side elevation of the view of FIG. 3A.

Referring first to FIGS. 1 through 3 there is shown a closure 10. The closure 10 comprises a body 15, a spout insert 20 and a self-closing valve assembly 25.

The body 15 comprises a generally cylindrical side wall 16 having at one end a tamper-evident annular ring 17 connected thereto by a plurality of frangible bridges 18.

The side wall 16 terminates at its end opposite the band 17 with an annular shoulder 16*c* which extends radially inwards. A generally turret-like lid 30 is connected to the free end of the shoulder 16*c* via a hinge 32.

The interior of the side wall 16 comprises internal screw thread formations 16*a* for engaging corresponding external screw thread formations on a container neck. The interior of the side wall 16 further comprises an annular retention bead 16*b*.

The interior of the band 17 comprises a plurality of upturned flaps 17*a* for engagement under a locking bead on a container neck so that if the closure is unscrewed the band will remain on a container neck.

The lid 30 comprises a generally hexagonal top plate 34 from which depends a spigot 36. Opposite the hinge 32 the lid 30 includes a small peak 38 used to lift the lid and flip it open with respect to the base 15.

A tamper-evident strip 40 is frangibly connected between the lid 30 and the base 15. The strip 40 terminates with a tab 42 at either end to allow it to be torn away prior to first opening of the lid.

Figure 4:
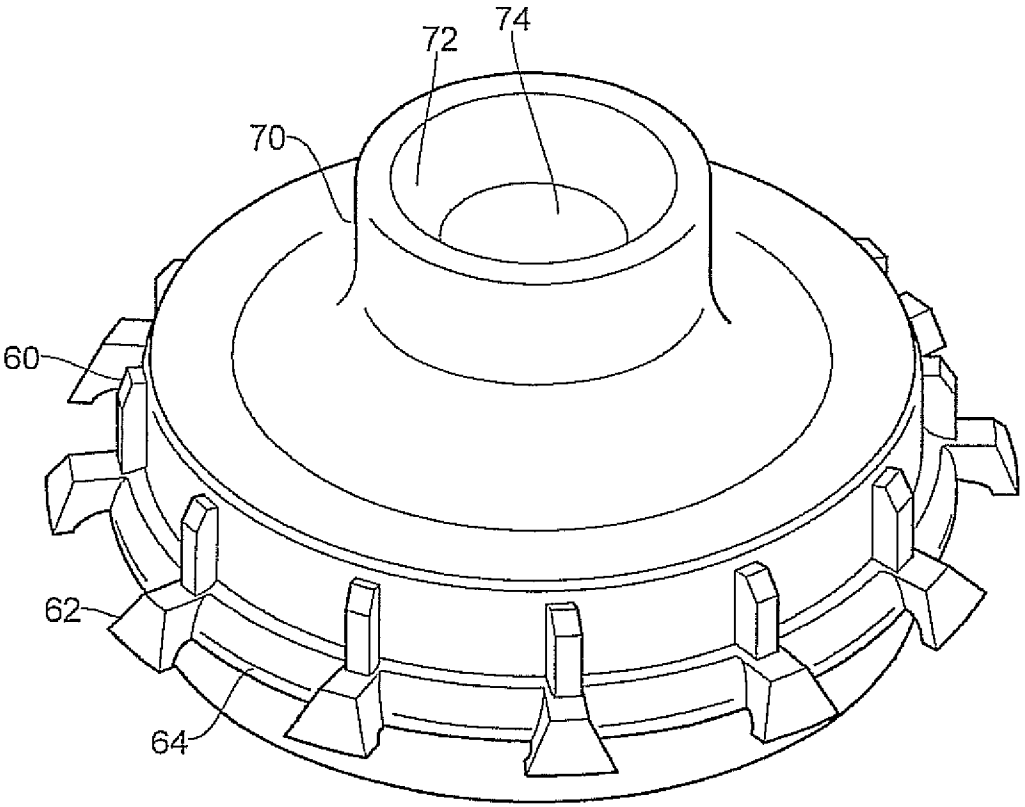
FIG. 4 is a perspective view of a spout insert forming part of the closure of FIGS. 1 through 3.

Referring now also to FIG. 4, the spout 20 comprises a generally cylindrical lower portion 50, a generally cylindrical central portion 51, and a generally frusto-conical upper portion 52.

Figure 5:
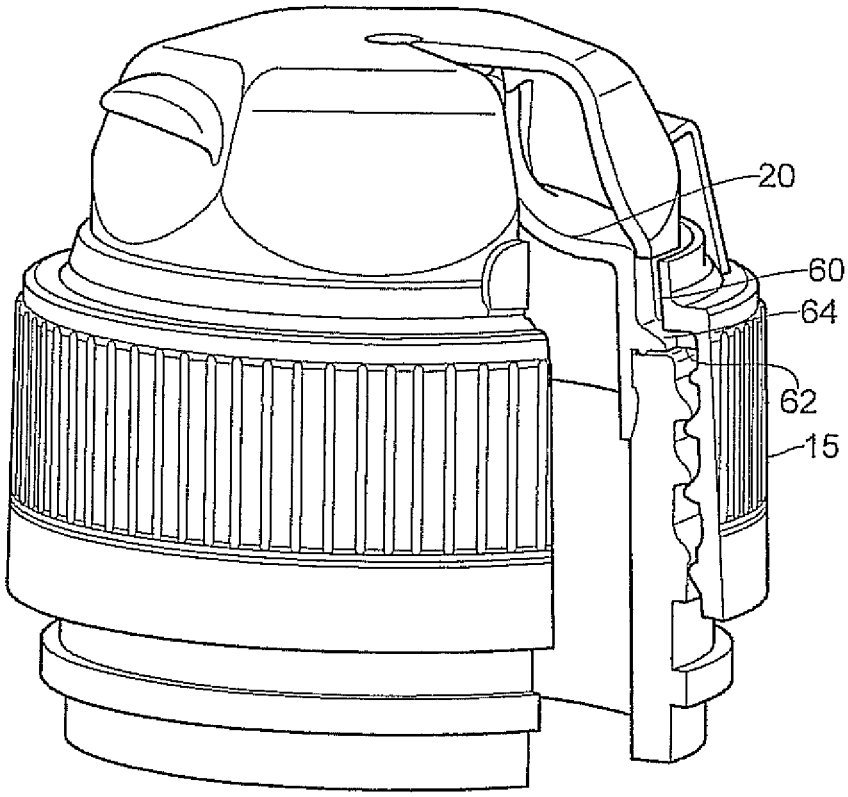
FIG. 5 is a perspective view of the closure of FIGS. 1 through 4 shown with a cut-out section illustrating the internal structure.
Figure 6:
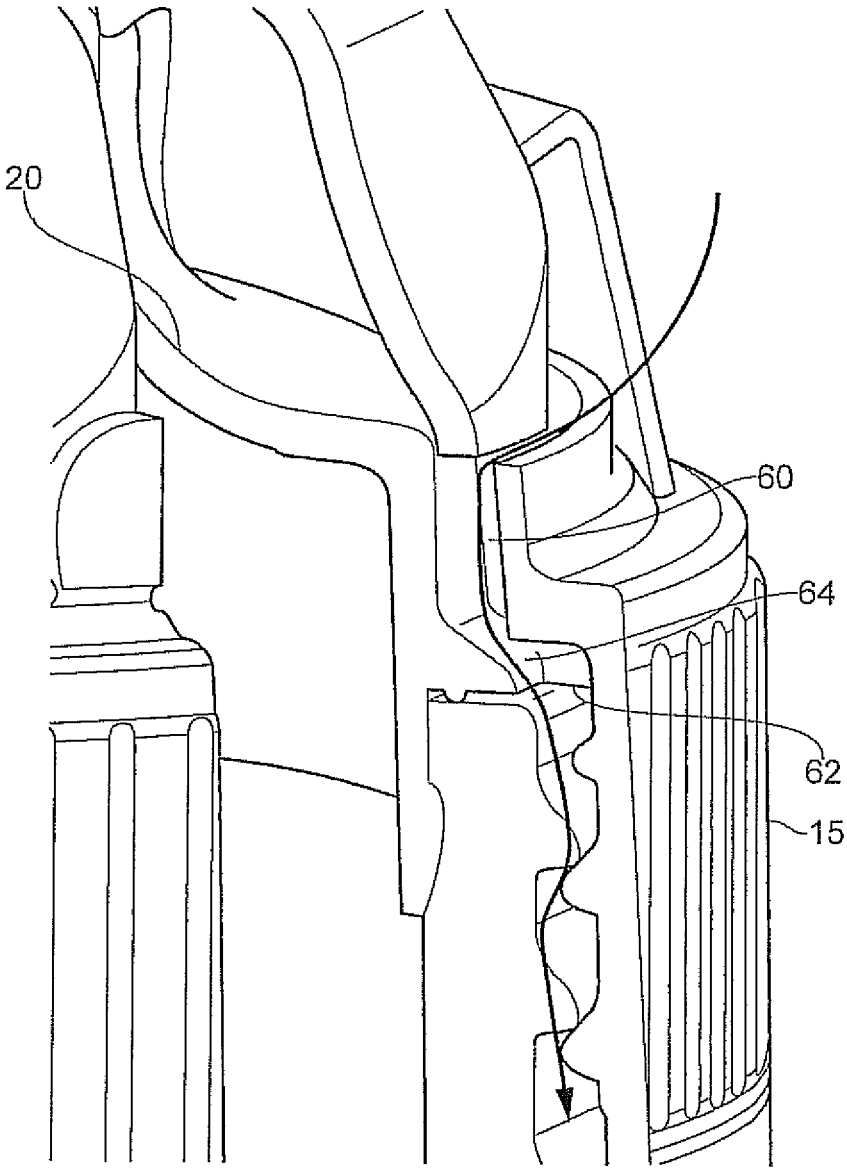
FIG. 6 is a magnified view of the cut-out section of FIG. 5.

The lower portion 50 comprises an annular sealing part 54 having an external sealing bead 56. In use, the sealing part 54 enters a container neck such that the sealing bead 56 seals against its inner surface (as shown in FIGS. 5 and 6).

The central retention portion 51 comprises an annular base 58 from which project a plurality of spaced axial ribs 60 which are used to secure the insert 20 in the body 15.

The base 58 further includes a plurality of radially outwardly extending retention spokes 62 positioned at the bottom of each rib 60. Between each spoke 62 is an inclined ledge 64 which extends radially outwardly approximately the same extent as the ribs 60. The spokes 62 are generally L-shaped with the shorter leg projecting away from the upper portion 52.

As shown in best in FIG. 1, the upper portion 52 comprises a curved, generally frusto-conical outer surface defining a spout. At the end of the spout side wall opposite the central portion 51 is a cylindrical terminal portion 70. An annular orifice wall 72 extends inwards from the free end of the portion 70 and defines an orifice 74. An annular retention bead 76 depends internally from the base of the terminal portion.

The self-closing valve assembly 25 comprises a body 26 and a valve 27. This structure is itself known from the Applicant's International Patent Application No PCT/EP2005/053917, the contents of which are incorporated herein by reference. The valve body 25 includes a retention bead 28 which clips over the spout retention bead. The valve assembly 25 is received between the retention bead 76 and the annular wall 72 as shown best in FIG. 1.

Referring now also to FIGS. 5 and 6, the spout 20 is received into the body 15. The retention spokes 62 engage over the retention bead 16*b* and the ribs 60 fit tightly within the orifice defined by the shoulder 16*c* so that the spout is held firmly in position. The ribs 60 also fit tightly within the lid 30 to hold it in the closed position. The spigot 36 enters the orifice 74 and abuts against the valve 27 to prevent it from opening with the lid closed.

As will be appreciated best from FIGS. 4 to 6, with the insert 20 in position slots are formed between the spokes 62 and ledges 64 of the central portion 51 and the side wall 16. Furthermore, a passage between the lid 30 and the base 58 is established by the ribs 60.

As illustrated in FIG. 6, when fluid is sprayed at the closure 10, it may enter the interior of the closure via the hinge line interface between the lid 30 and the base 15. If this happens, the fluid can pass between the ribs 60 and down over the ledges 64 before passing through the slots and then between the closure and container screw threads and out at the bottom of the side wall 16. This means that there is an unobstructed drainage path for fluid to follow if it enters the closure. It may be necessary to force fluid through the drainage path, for example by blowing air at the closure.

In the claims, means or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a wooden part, in the environment of fastening wooden parts, a nail, a screw, and a bolt may be readily understood by those skilled in the art as equivalent structures.

Having described at least one of the preferred embodiments of the present invention with reference to the accompanying drawings, it is to be understood that the invention is not limited to those precise embodiments, and that various changes, modifications, and adaptations may be effected therein by one skilled in the art without departing from the scope or spirit of the invention as defined in the appended claims.

The invention claimed is:

1. A closure, said closure comprising:
(a) a body, said body further comprising:
(i) a base; and
(ii) a lid;
(b) an insert; and
(c) one or more drainage paths for allowing fluid applied to said closure and entering between said base and said lid to pass between an exterior of said insert and an interior of said body to allow removal thereof,
wherein said base and said lid are connected by a hinge.

2. A closure, according to claim 1, in which said one or more drainage paths are formed at an interface between said insert and said body.

3. A closure, according to claim 2, in which each one of said one or more drainage paths comprises one or more slots formed at a periphery of said insert.

4. A closure, according to claim 3, in which said one or more slots comprise an inclined drainage face.

5. A closure, according to claim 1, in which said insert comprises a plurality of ribs at its periphery.

6. A closure, according to claim 5, in which at least one of said slots are formed between said plurality of ribs.

7. A closure, according to claim 6, in which at least one of said slots comprise an inclined drainage face.

8. A closure, according to claim 1, in which said insert further comprises a plurality of mutually spaced retention spokes.

9. A closure, according to claim 8, in which said plurality of mutually spaced retention spokes define, at least in part, said one or more drainage paths.

10. A closure, according to claim 1, in which said insert comprises a spout.

11. A closure, according to claim 1, in which said lid is generally turret-like.

12. A closure, according to claim 1, in which said closure further comprises a self-closing valve.

13. A container comprising a closure, said closure further comprising:
(a) a body, said body further comprising:
(i) a base having an interior surface; and
(ii) a lid;
(b) an insert having an exterior surface; and
(c) one or more drainage paths for allowing fluid applied to said closure and entering between said base and said lid to pass between the exterior surface of said insert and the interior surface of said body to allow removal thereof,
wherein said insert comprises a spout.

14. A container, according to claim 13, in which said lid is generally turret-like.

15. A container, according to claim 13, in which said closure further comprises a self-closing valve.

16. A container, according to claim 13, in which said base and said lid are connected by a hinge.

17. An insert having an exterior surface for a closure body having an interior surface, including a base and a lid, said insert comprising:

(a) an annular base;

(b) a spout; and (c) one or more drainage paths for allowing fluid applied to said closure body and entering between said base and said lid to pass between the exterior surface of said insert and the interior surface of said closure body to allow removal thereof, wherein said insert comprises a plurality of mutually spaced retention spokes on said annular base, and wherein said plurality of mutually spaced retention spokes define, at least in part, said one or more drainage paths.

* * * * *